US005388479A

United States Patent [19]

Sroka

[11] Patent Number: 5,388,479

[45] Date of Patent: Feb. 14, 1995

[54] UNIVERSAL RATCHET WRENCH

[76] Inventor: John Sroka, 5055 Timberedge Rd., Richfield, Ohio 44286

[21] Appl. No.: 117,540

[22] Filed: Sep. 7, 1993

[51] Int. Cl.[6] ..... B25B 13/00

[52] U.S. Cl. ..... 81/58.2; 81/63.1

[58] Field of Search ..... 81/58.2, 58.3, 60, 63.1

[56] References Cited

U.S. PATENT DOCUMENTS

| | | |
|---|---|---|
| 923,942 | 6/1909 | Brockway . |
| 2,376,575 | 5/1945 | Cronan . |
| 2,649,823 | 8/1953 | Markovich . |
| 2,691,315 | 10/1954 | Brame . |
| 2,699,082 | 1/1955 | Viets . |
| 2,712,256 | 7/1955 | Fish . |
| 2,851,914 | 9/1958 | Zeckzer . |
| 3,927,582 | 12/1975 | Hertelendy et al. . |
| 4,030,384 | 6/1977 | Newman . |
| 4,270,417 | 6/1981 | Tesoro . |
| 4,479,409 | 10/1984 | Antonius . |

*Primary Examiner*—James G. Smith

*Attorney, Agent, or Firm*—Roylance, Abrams, Berdo & Goodman

[57] ABSTRACT

An open-ended ratchet wrench including a handle joined to a crescent-shaped end portion. Rotatable within the crescent-shaped head portion is a jaw member that is rotatable within the crescent-shaped head portion, the jaw member being rotatable about an axis which passes through the crescent-shaped head portion. A spring biased ratchet member is displaceable in a direction parallel to the axis of rotation of the jaw member and is configured to engage and disengage the jaw member to either limit rotation of the jaw member in one direction and one direction only and in a release position to allow the jaw member to rotate freely in either direction.

14 Claims, 14 Drawing Sheets 70
25
60
170
40
65
160
150
162
10
190
180
22
23
17
15
23a
200
195
205
210
207
360
356
355
348
22'
50'
340
347
325
50
180'
247
248

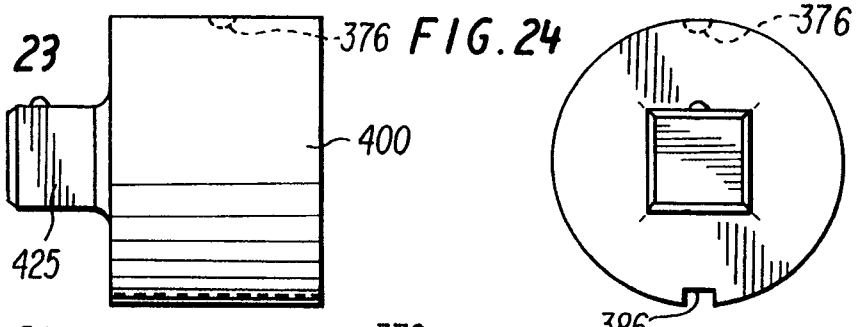
FIG. 23
FIG. 24
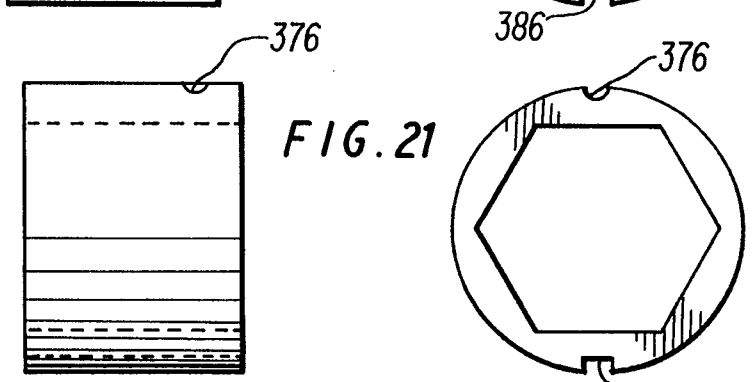
FIG. 22
FIG. 21
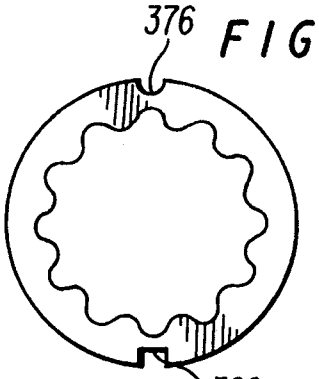
FIG. 26
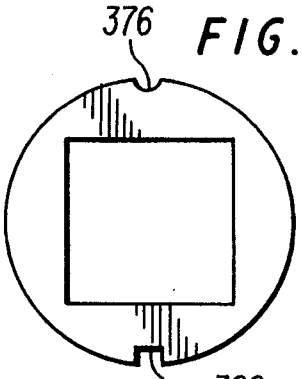
FIG. 25
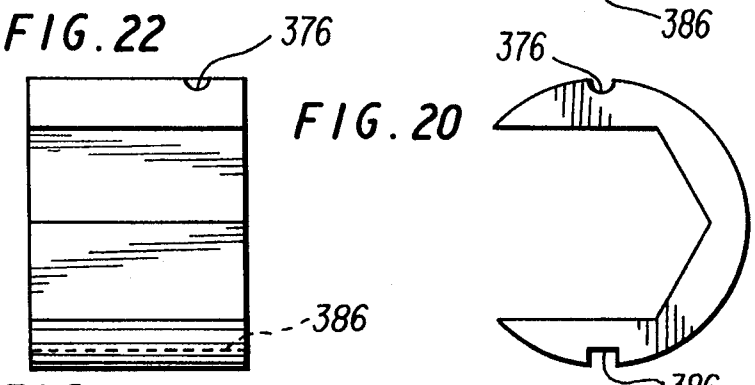
FIG. 19
FIG. 20
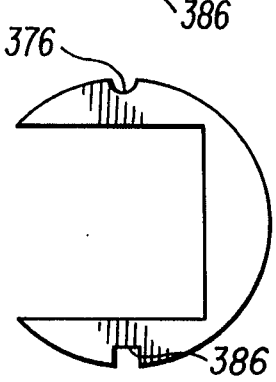
FIG. 18
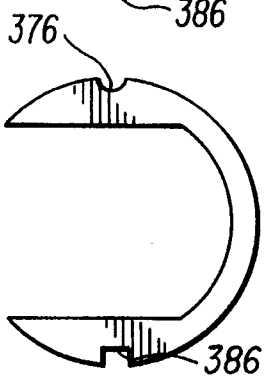
FIG. 17

UNIVERSAL RATCHET WRENCH

BACKGROUND OF THE INVENTION

The invention relates to a universal open end ratchet wrench for tightening or loosening nuts, bolts and fasteners.

Ratchet wrenches are well known. Most ratchet wrenches utilize a socket, where the socket includes an opening formed in the shape of a specific fastener size, for example, a half inch hexagonal bolt or a 14 mm twelve point bolt head. Most ratchet wrenches are sold with a variety of sockets, each socket designed to fit a specific sized bolt or nut.

In such wrenches, the wrench includes means for securing the socket to a ratchet mechanism such that a variety of sockets may be interchangeably attached to the wrench. In recent years, ratchet wrenches and sockets have been standardized where the ratchet wrench includes a protruding shank that is ⅜ inch square and the socket has a ⅜ inch square opening to accommodate the shank. Another standard size ratchet wrench shank is ½ inch square with the sockets having corresponding ½ inch square openings.

Typically, a ratchet wrench selectively allows the socket to rotate freely in one direction, but inhibits rotation in the reverse direction so that as a bolt is tightened or loosened, the wrench does not need to be removed from the bolt.

Open end wrenches have been used for over a century. Open end wrenches typically have a U-shaped opening at one end with opposed parallel faces that are manufactured to fit one single bolt or nut size. Open end wrenches allow a technician or handyman to engage a bolt or nut when only a radial face of the bolt or nut is exposed. A drawback to an open end wrench is that the user must constantly remove the wrench from the bolt or nut and reposition the wrench in order to tighten or loosen the bolt or nut.

Also well known are open end ratchet wrenches where the ratchet wrench includes a rotatable element that has a gap formed therein to allow the wrench to slide over a bolt or nut in a manner similar to an open end wrench. Examples of such wrenches are shown in the following patents:

U.S. Pat. No. 4,479,409 to Antonius
U.S. Pat. No. 3,927,582 to Hertelendy et al.
U.S. Pat. No. 2,851,914 to Zeckzer
U.S. Pat. No. 2,712,256 to Fish
U.S. Pat. No. 2,699,082 to Viets
U.S. Pat. No. 2,691,315 to Brame
U.S. Pat. No. 2,649,823 to Markovich
U.S. Pat. No. 2,376,575 to Cronan
U.S. Pat. No. 923,942 to Brockway.

Open end ratchet wrenches have the obvious advantage over traditional open end wrenches of enabling a workman to progressively turn a nut or bolt without having to continually remove and reposition the wrench.

Problems with previous open end ratchet wrenches relate to the ratchet mechanism itself. For instance, in U.S. Pat. 2,376,575 to Cronan, the wrench includes a ratchet member having a circular shape with a gap formed therein for receiving a bolt or nut. The rotatable ratchet member has teeth formed on its outer circumference which become exposed as the ratchet member rotates. The teeth are damaged easily when left in an exposed position. The teeth may also present a safety hazard. For instance, if left exposed, the protruding teeth might puncture the skin of the user, or cause abrasions to skin in contact with them.

Another disadvantage to the Cronan '575 wrench is the inclusion of four pawls in the ratchet mechanism. The design is complicated in execution, making it difficult to assemble and repair. Further, the pawl members when worn slightly, may fail to engage the ratchet teeth on the rotatable wrench member in concert, thus making failure of one or more of the pawl members more likely.

Yet another shortcoming of the wrench disclosed in the Cronan '575 patent is that the radially extending ratchet teeth make it necessary to increase the overall diameter of the open end of the ratchet wrench. A wide diameter end is undesirable because it limits the applications where the wrench can be utilized, in particular, in small spaces where there is a finite amount of space near a bolt or nut.

A further disadvantage to the designs in the prior art lies in the likelihood that the rotatable element in the ratchet mechanism may eventually become bent or warped, in which case, rotation of the element may become limited or may be impossible altogether.

SUMMARY OF THE INVENTION

In one aspect of the invention an open-ended ratchet wrench is provided which includes an elongated metallic arm having a head at one end with U-shaped open end for receiving a bolt or nut. The open end of the head of the wrench includes a recess which retains a ratchet wheel that is formed with a gap in its outer circumference for receiving nuts and/or bolts. The ratchet wheel is configured to rotate within the recess about an axis defined within the open end of the wrench.

The ratchet wheel is formed with a smooth outer radial lip which defines a circumferential recess on an inner axially extending face of the wheel. The lip partially covers and protects the wheel recess. Within the wheel recess, on a surface that is generally perpendicular to the axis about which wheel rotates, a plurality of ratchet-type gear teeth are formed. The gear teeth are configured to engage a pawl having corresponding pawl teeth. The pawl is retained within a recess of the head and partially extends into the recess of the wheel. The pawl is spring biased so that its teeth engage the gear teeth on the ratchet wheel.

The pawl is capable of limited movement in a direction parallel to the axis about which the ratchet wheel rotates. The movement of the pawl is effected by a release mechanism that includes a cam which interacts with the pawl so that it can selectively engage or disengage the teeth on the ratchet wheel as desired. When the pawl engages the wheel, the wheel is capable of rotation in only one direction. When the pawl is disengaged or spaced apart from the wheel, the wheel is capable of rotation in both directions.

In one embodiment of the invention, a cam is formed on a shaft which extends through a bore formed in the wrench handle. At one end of the shaft is a lever which protrudes slightly from one side of the handle arm. Movement of the lever effects engagement and disengagement of the pawl with the ratchet wheel.

In an alternate embodiment, the engagement and disengagement of the pawl is effected by movement of two parallel reciprocable pins, each pin provided with a tapered surface at one end which serves a first cam and a rounded head at the other end. Each pin is disposed within parallel apertures in the wrench handle. The tapered surface of each pin is engagable with a pair of corresponding apertures formed in the pawl. Movement of the pins into the apertures formed in the pawl disengages the pawl from the ratchet wheel. Movement of each pin is effected by an actuating shaft disposed in a bore in the handle that is perpendicular to the parallel pin apertures. The actuating shaft is formed with a pair of second cams, each second cam being selectively engagable with a head of one of the pins.

In yet another embodiment of the invention, the ratchet wheel is provided with a second recess on a second axially extending face, the second recess having teeth formed therein. A second pawl disposed within the handle recess has pawl teeth which selectively engage the teeth in the second recess. In this embodiment, the ratchet wheel can be controlled so that in will only rotate in: (1) a first direction; (2) the opposite direction; or (3) rotate freely in both directions.

BRIEF DESCRIPTION OF THE DRAWINGS

Further advantages of the disclosed invention will become apparent from a reading of the following description when read in conjunction with the accompanying drawings in which:

FIGS. 17–26 depict a variety of sockets which may be inserted into the ratchet wheel of the wrench the present invention.

DETAILED DESCRIPTION OF THE DRAWINGS AND PREFERRED EMBODIMENTS

Figure 1:
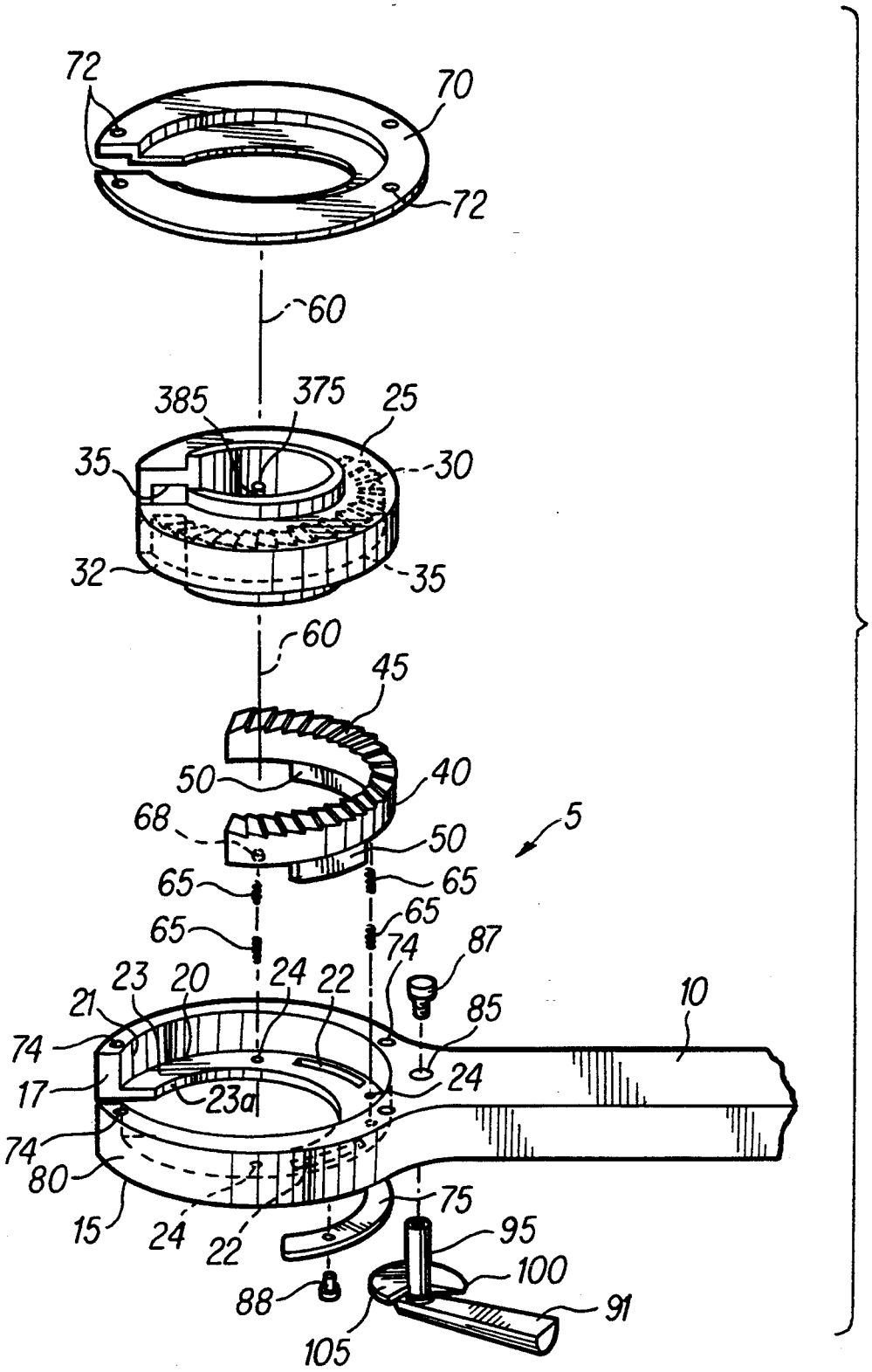
FIG. 1 is a fragmentary, exploded, perspective view of a first embodiment of the ratchet wrench depicting the elements which effect engagement and disengagement of the pawl from the ratchet wheel wherein some of the elements are positioned adjacent to the underside of the wrench handle.

With reference to the drawings wherein like reference characters represent like components throughout the various views, and with particular reference to FIG. 1, there is depicted an open-ended ratchet wrench 5 having a handle 10 and a head 15. It should be understood, however, that the handle 10 is an elongated member and extends well beyond the depiction shown in FIG. 1, as is well known in the art.

Figure 2:
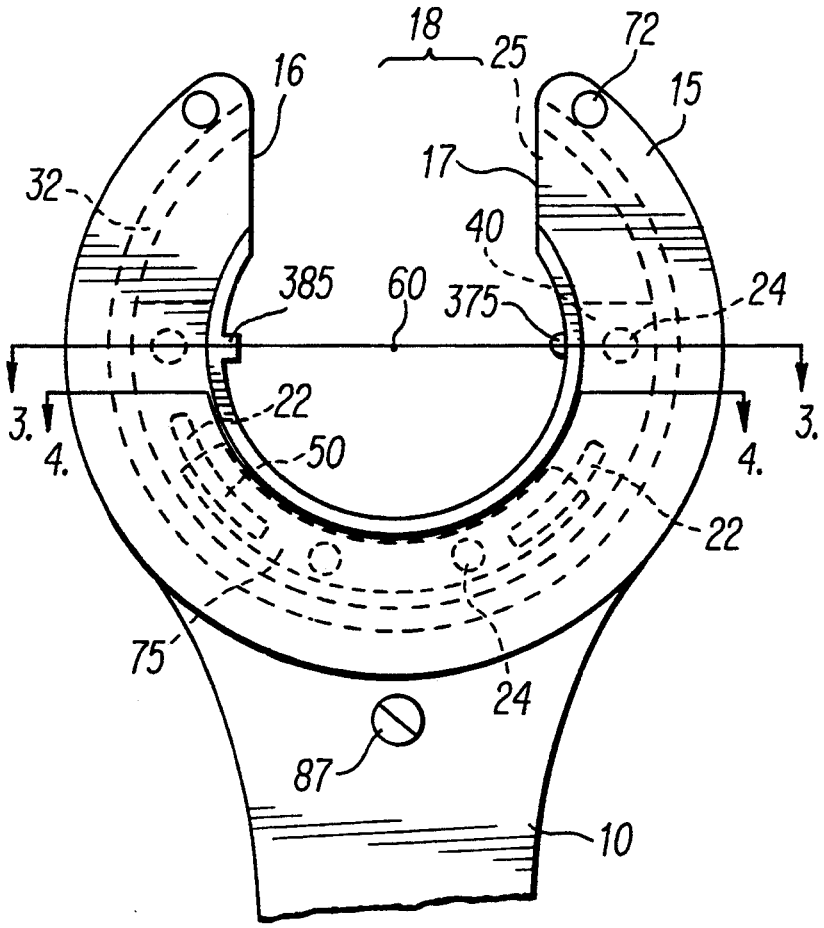
FIG. 2 is a fragmentary top view of the ratchet wrench shown in FIG. 1 with some of the parts of the wrench shown in phantom.

The wrench is provided with a rounded head 15. As can be seen more clearly in FIG. 2, the head 15 is formed with a gap 18 having generally parallel opposing faces 16 and 17. The head 15 is also formed with a recess 20 (FIG. 1) that provides a side wall 21 having generally cylindrical contour. The cylindrical contour of the side wall 21 is formed about an axis 60 that extends generally through the center of the head 15. The head 15 is formed with a radially extending flange 23*a* that has an upper surface 23 that forms the bottom of the recess 20. The flange surface 23 is generally planar and is perpendicular to the axis 60.

Two keyway slots 22 are formed in the head 15 which extend through the flange 23*a* from the flange surface 23 to the underside 80 of the handle 10. The purpose of the keyway slots 22 will be explained below. Four small holes 24 are formed in the surface 23 of the flange 23*a*, which do not extend through the flange 23*a* to the underside 80 of the head 15. The purpose of the four holes 24 is to provide seats for the springs 65, as will be explained in greater detail below.

As is depicted in FIGS. 1, 2, 3A and 4, a ratchet wheel 25 is disposed within the recess 20 and is rotatable about the axis 60. The ratchet wheel 25 is generally circular in shape but is formed with a gap which conforms to and can be aligned with the gap 18 in the open end of the head 15. The ratchet wheel 25 is formed with a generally cylindrical recess 35 (FIGS. 1 and 3A) and an outer circumferential lip 32. The wheel 25 is formed with ratchet teeth 30 at the bottom surface of the recess 35.

Figure 3A:
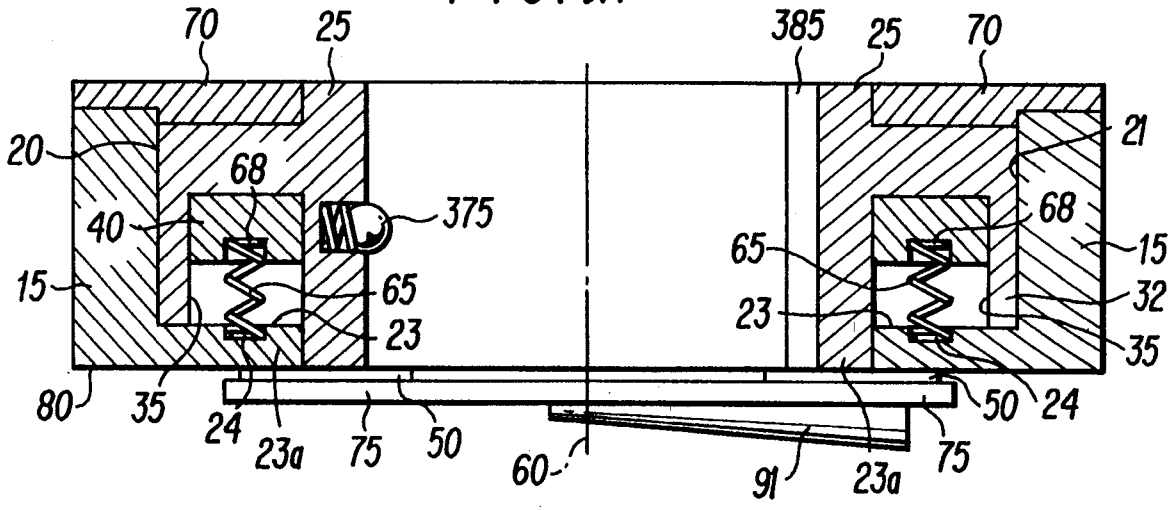
FIG. 3A is a section of the wrench taken along the line 3—3 in FIG. 2 looking in the direction of the arrows, on a slightly enlarged scale from that of FIG. 2, showing the pawl engaged with the ratchet wheel.
Figure 4:
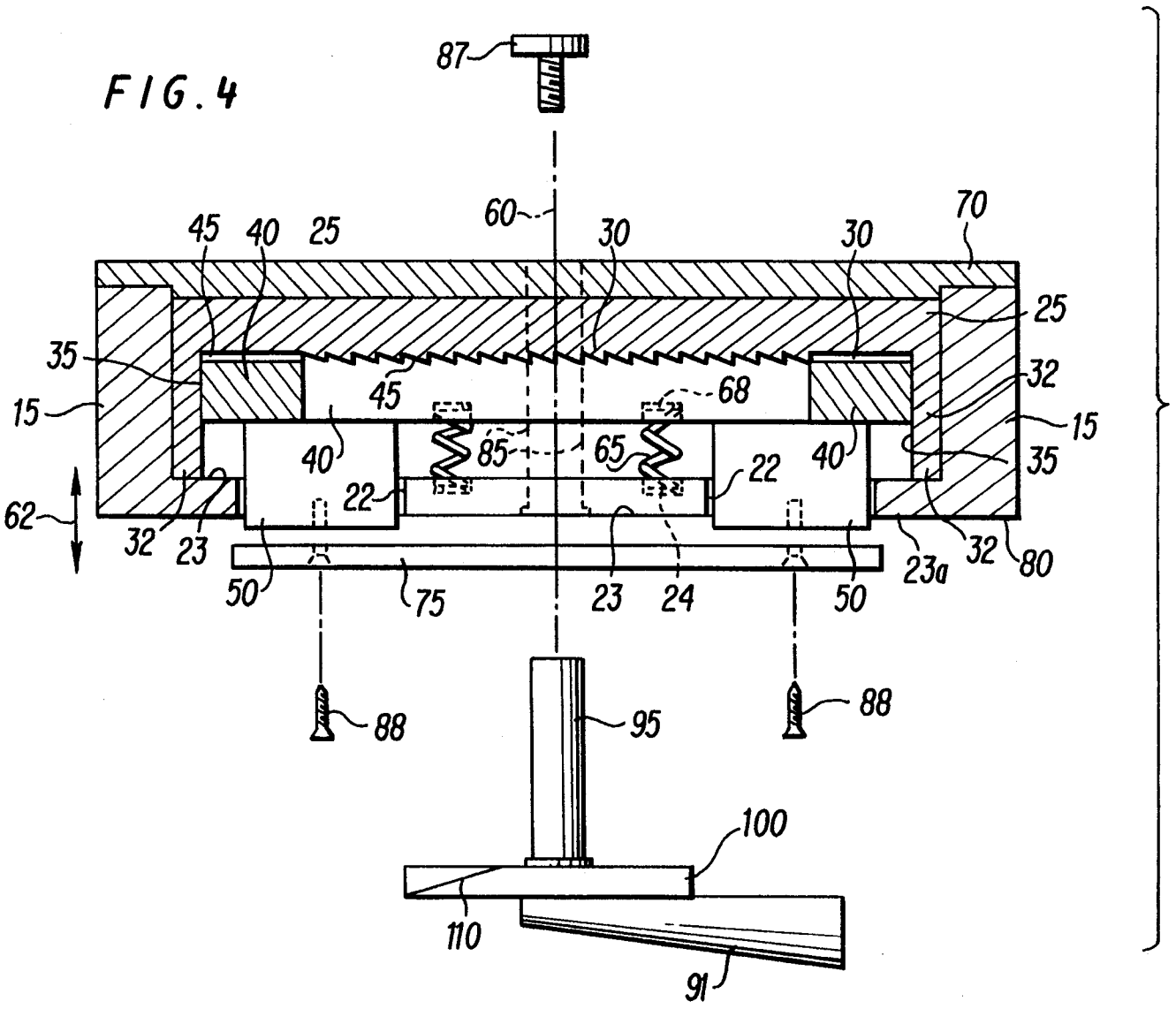
FIG. 4 is a section of the wrench taken along the line 4—4 in FIG. 2 and part exploded side elevation of the wrench on a slightly enlarged scale from that of FIG. 2, showing a lever and the elements which effect engagement and disengagement of the pawl from the wheel, disassembled from the wrench handle.

As is shown in FIGS. 1, 3A and 4, upon assembly of the wrench, a pawl 40 is disposed in the recess 20 in the head 15 and partially extends into the recess 35 in the wheel 25. The pawl 40 is formed with pawl teeth 45. The pawl 40 also includes two protruding, downwardly depending keys 50. The keys 50 are configured to fit within the keyway slots 22. The interaction of the keys 50 and keyway slots 22 restricts rotational movement of the pawl 40 within the head 15 but allows for the pawl 40 to move in directions indicated by the arrows 62 in FIG. 4, generally parallel to the axis 60.

Disposed within the four holes 24 in the flange surface 23 are the four springs 65 respectively, that project upwardly relative to FIG. 1, to extend into corresponding holes 68 (FIGS. 1, 3A, 3B and 4) on the underside of the pawl 40. The springs 65 bias the pawl 40 away from the flange surface 23 and constantly urge the pawl teeth 45 into engagement with the ratchet teeth 30 of the ratchet wheel 25. In its operative position, the pawl 40, with its ratchet teeth 45 engaging the teeth 30 on the ratchet wheel 25, allows the ratchet wheel 25 to rotate in one direction only.

A cover 70 retains the pawl 40 and the ratchet wheel 25 within the recess 20 of the head 15. The cover 70 is formed with a plurality of holes 72 through which a plurality of screws (not shown) extend. The screws thread into threaded holes 74 in the head 15.

The handle 10 also includes a bore 85 (FIGS. 1, 2 and 4) which extends completely through the handle 10, through which a shaft 95 of a release mechanism extends. The shaft 95 is rigidly attached to a lever 91, and are both are shown removed from the bore 85 in FIGS. 1 and 4. The shaft 95 includes a cam 100 (FIGS. 1 and 4) having a flat surface 105 and a cam surface 110. The shaft 95 extends through the bore 85 and is secured by the threaded screw 87 (FIGS. 1 and 4) but is capable of limited rotation within the bore 85.

Referring now to FIGS. 1, 3A, 3B and 4, a release plate 75 attachable to the keys 50 on the underside of the pawl 40 by screws 88 (FIGS. 1 and 4). The release plate 75 has a crescent moon shape as can be seen in FIG. 1 and in phantom in FIG. 2.

Figure 3B:
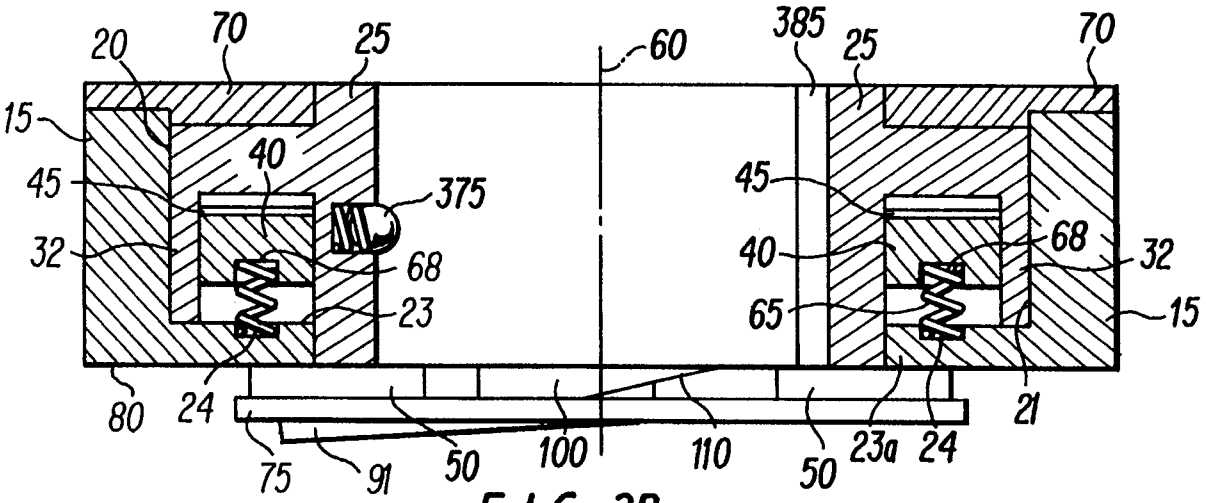
FIG. 3B is a part section of the wrench, taken along the line 3—3 in FIG. 2, looking in the direction of the arrows, on a slightly enlarged scale from that of FIG. 2, showing the pawl disengaged from the ratchet wheel.

When assembled, the flat surface 105 of the release mechanism engages the underside 80 of the handle 10, and the cam surface 110 may selectively be brought into contact with the release plate 75 by movement of the lever 91 and corresponding rotation of the shaft 95. When the lever 91 of the release mechanism is rotated to bring cam surface 110 into contact with the release plate 75, the cam 100 is forced between the release plate 75 and the underside 80 of the handle 10 and the plate 75 is moved away from the underside 80 of the handle 10 as is depicted in FIG. 3B. As the release plate 75 moves away from the underside 80 of the handle 10, the pawl 40 is moved away from the ratchet teeth 30 on the ratchet wheel 25 as is shown in FIG. 3B. When the pawl is moved out of engagement with the teeth 30 on the ratchet wheel 25, the wheel 25 is free to rotate in both direction about the axis 60.

When the release lever 91 is turned to move the cam surface 110 out of contact with the release plate 75, the springs 65 urge the pawl 40 into contact with the teeth 30 on the wheel 35 and restrict the rotation of the wheel 35 to one direction, as is depicted in FIG. 3A.

The lip 32 on the outer edge of the ratchet wheel 25 partially shields and protects the ratchet teeth 30 along the radial edge of the wheel 25. When assembled, the outer surface of the lip 32 of the wheel 25 contacts the surface 21 within the recess 20 in the head 15 and provides a bearing surface during rotation of the wheel 25.

The ratchet wheel 25 is provided on its inner circumference with a key 386 and a ball detente 375 for retaining any of a variety of wrench sockets as will be described in greater detail below.

Figure 5:
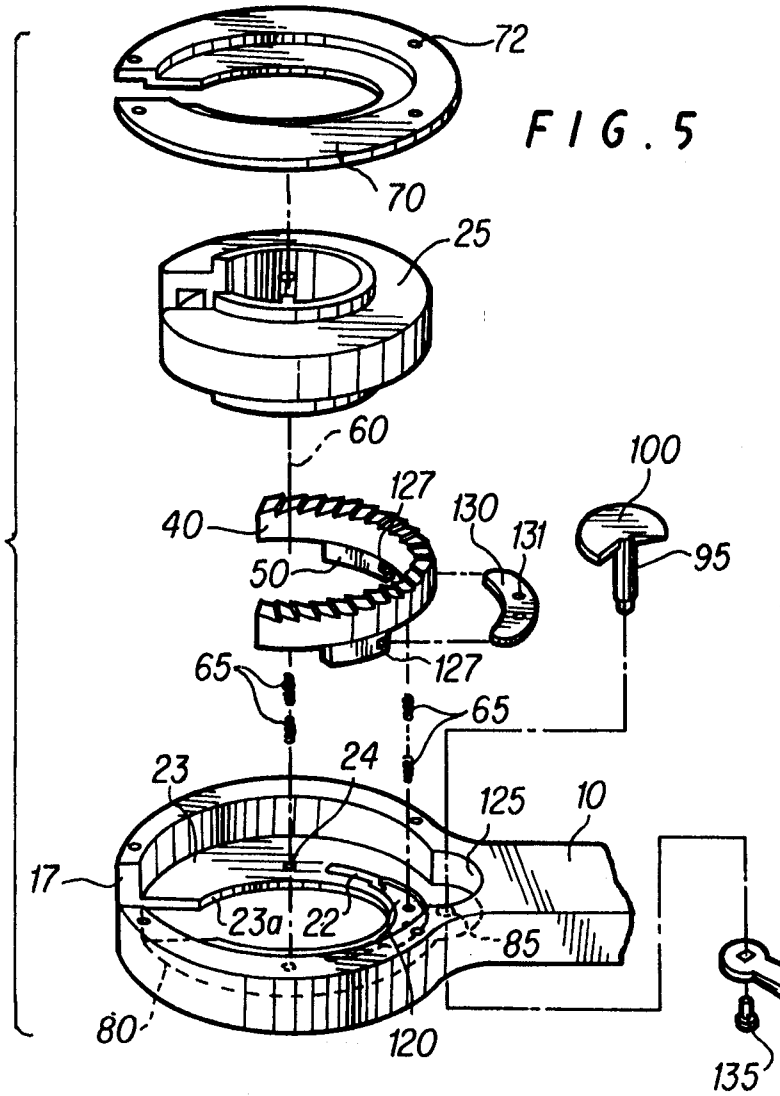
FIG. 5 is a fragmentary, exploded view of a second embodiment of the ratchet wrench wherein the elements that effect engagement and disengagement of the pawl from the ratchet wheel are partially disposed within recesses formed the wrench handle.
Figure 6:
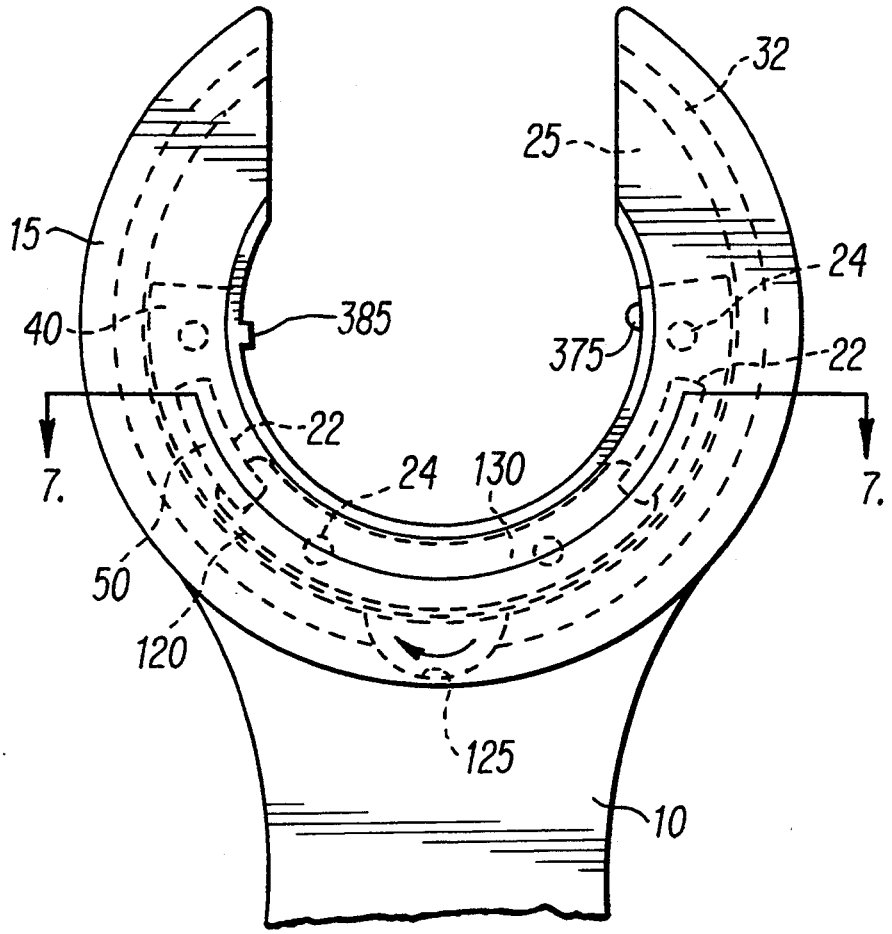
FIG. 6 is a fragmentary top view of the wrench in FIG. 5 on an enlarged scale, showing some of the parts of the wrench in phantom.

A second embodiment of the present invention is depicted in FIGS. 5, 6, 7A and 7B. In the second embodiment, many of the elements of the first embodiment are present, for example, the handle 10, the pawl 40, the ratchet wheel 25, the head 15 of the handle 10, the cover 70 and the springs 65. However, in the second embodiment, the flange 23*a* includes a secondary recess 120 that is crescent moon shaped and extends between the two keyway slots 22 (FIGS. 5 and 6). A cam slot 125 is also formed within the handle 10 adjacent to the recess 20. The bore 85 is generally centered within the cam slot 125.

The release mechanism in the second embodiment includes a shaft 95 rigidly attached to a cam 100 and shaft 95 and a lever 91 that attaches to the shaft 95. When assembled, the cam 100 is disposed for rotation within the cam slot 125, while the lever 91 is positioned adjacent to the underside 80 of the handle 10. The lever 91 attaches to the shaft 95 via a screw 135, as shown in FIG. 5.

The each key 50 of the pawl 40 in the second embodiment is provided with a slot 127. A release plate 130 is secured to the pawl 40 by insertion into the slots 127 as is indicated in FIG. 5 and shown clearly in FIGS. 7A and 7B. When assembled, the release plate 130 is partially disposed within the secondary recess 120.

Figure 7A:
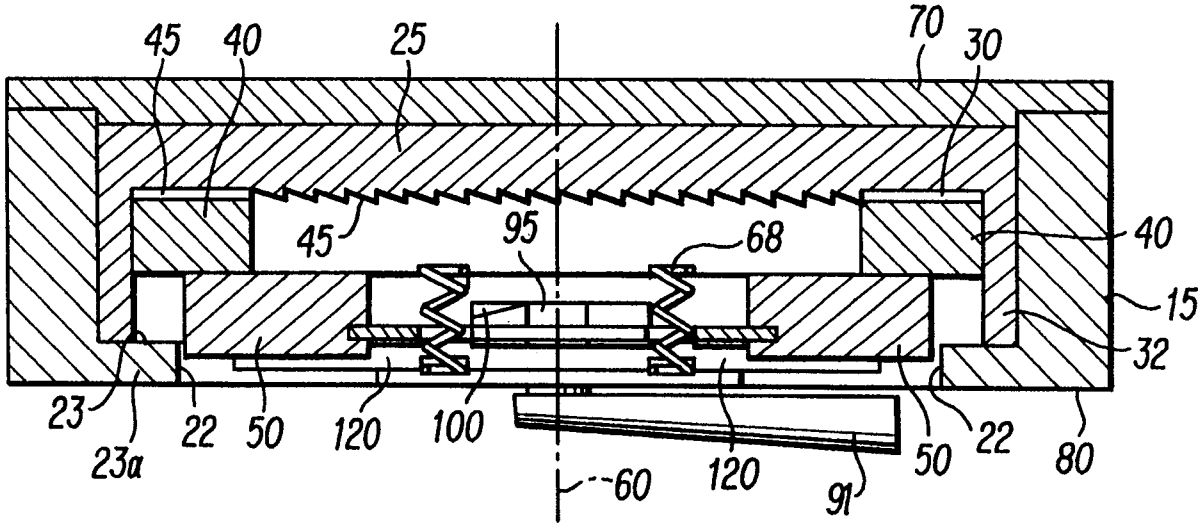
FIG. 7A is a fragmentary section of the wrench taken along the line 7—7 in FIG. 6, looking in the direction of the arrows, showing the pawl engaged with the ratchet wheel.
Figure 7B:
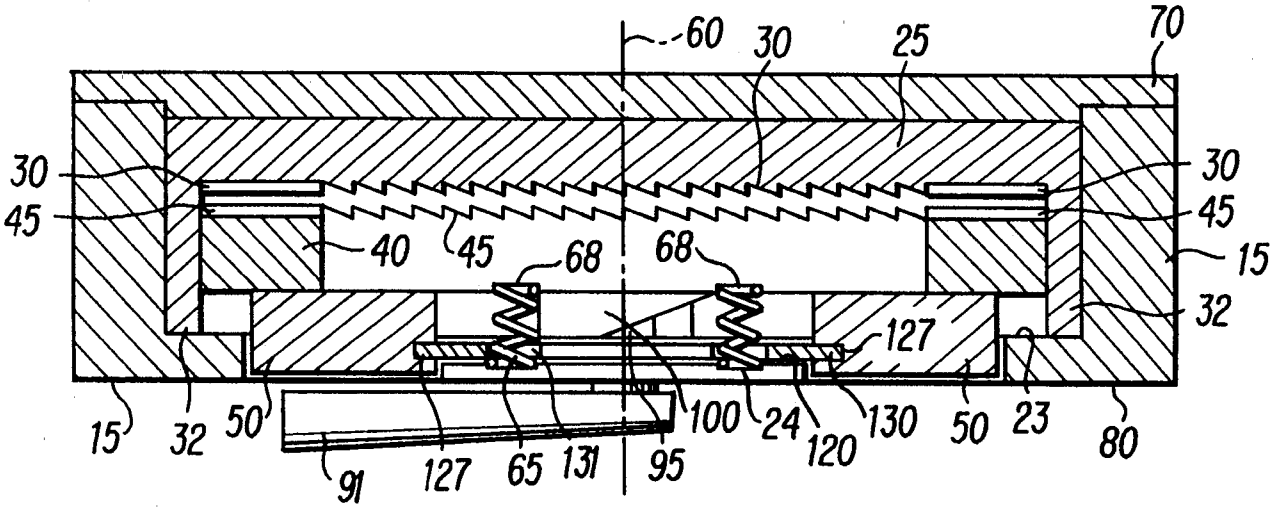
FIG. 7B is a fragmentary side view of the wrench, taken along the lines 7—7 in FIG. 6 on a slightly enlarged scale, looking in the direction of the arrows, showing the pawl disengaged from the ratchet wheel.

The release mechanism of the second embodiment operates as follows. When the when the lever 91 is rotated, the cam 100 engages the release plate 130 urging it into the recess 120 and bringing the pawl 40 and the pawl teeth 45 out of engagement with the teeth 30 on the wheel 25, thus allowing the ratchet wheel 25 to rotate freely in either direction as is depicted in FIG. 7B. When the lever 91 is rotated to disengage the cam 100 from the release plate 130 then the springs 65 urge the pawl 40 back into engagement with the wheel 25 thus restricting rotation of the wheel 25 to one direction only as is depicted in FIG. 7A. The springs 65 extend through the holes 131 in the release plate 130 and are seated in the holes 68 and 24.

In a third embodiment depicted in FIGS. 8, 9, 10A and 10B, many of the elements in the previous embodiments are present, for instance, the handle 10, the keyway slots 22, the ratchet wheel 25, the pawl 40 the keys 50 formed on the pawl 40, the cover 70 and the springs 65. However, in this embodiment the pawl 40 is formed with two apertures 170. The two apertures 170 are generally parallel to each other and are generally perpendicular to the axis 60. The purpose of the apertures 170 will be explained below.

Figures 8, 12:
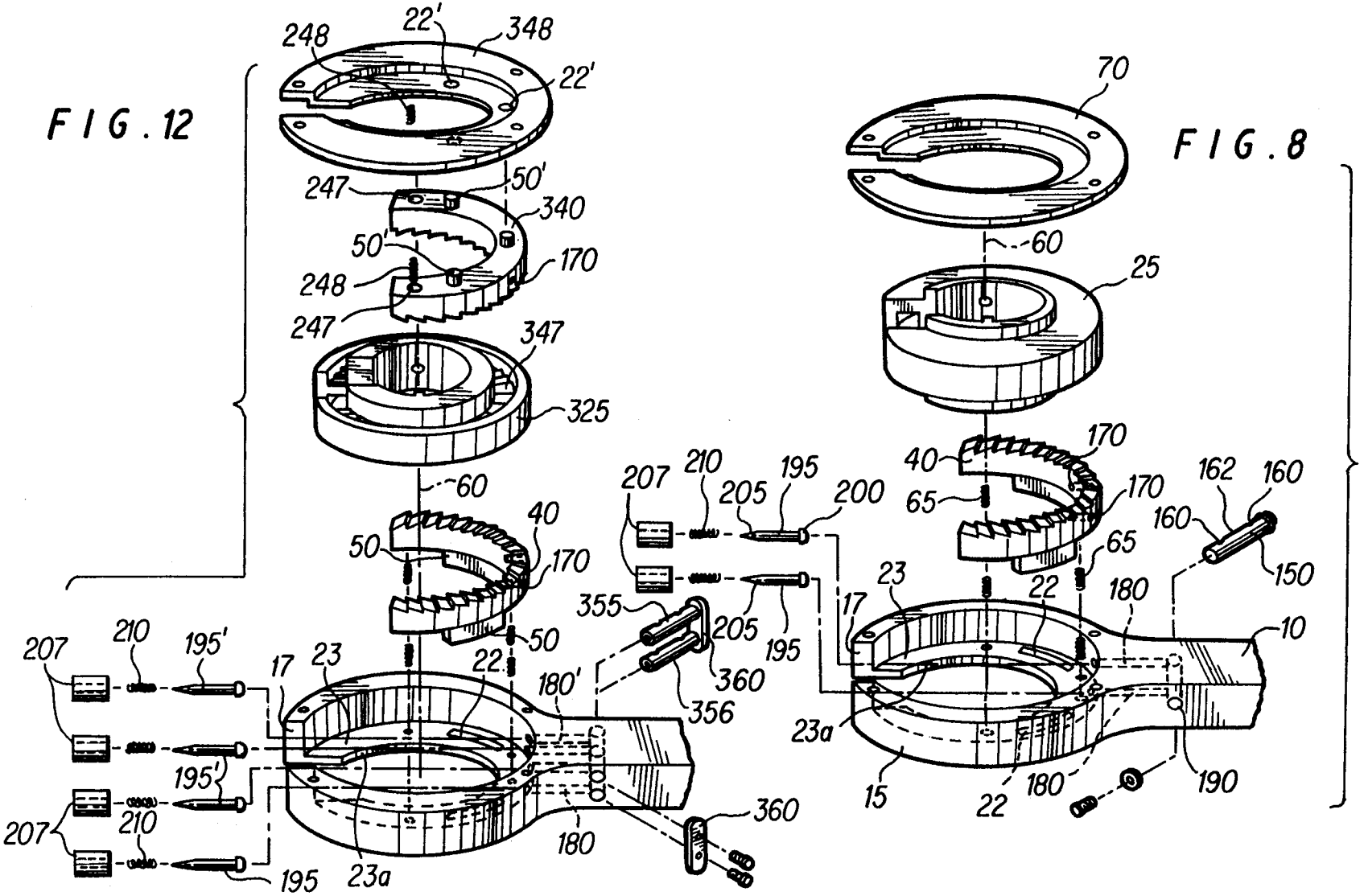
FIG. 8 is a fragmentary exploded perspective view of a third embodiment of the wrench wherein a slidable actuator shaft effects engagement and disengagement of the pawl with the ratchet wheel.
FIG. 12 is a fragmentary, perspective, exploded view of a fifth embodiment of the wrench wherein two pawl are employed, each pawl engagable with corresponding gear teeth disposed on the two axially extending sides of a ratchet wheel.
Figure 9:
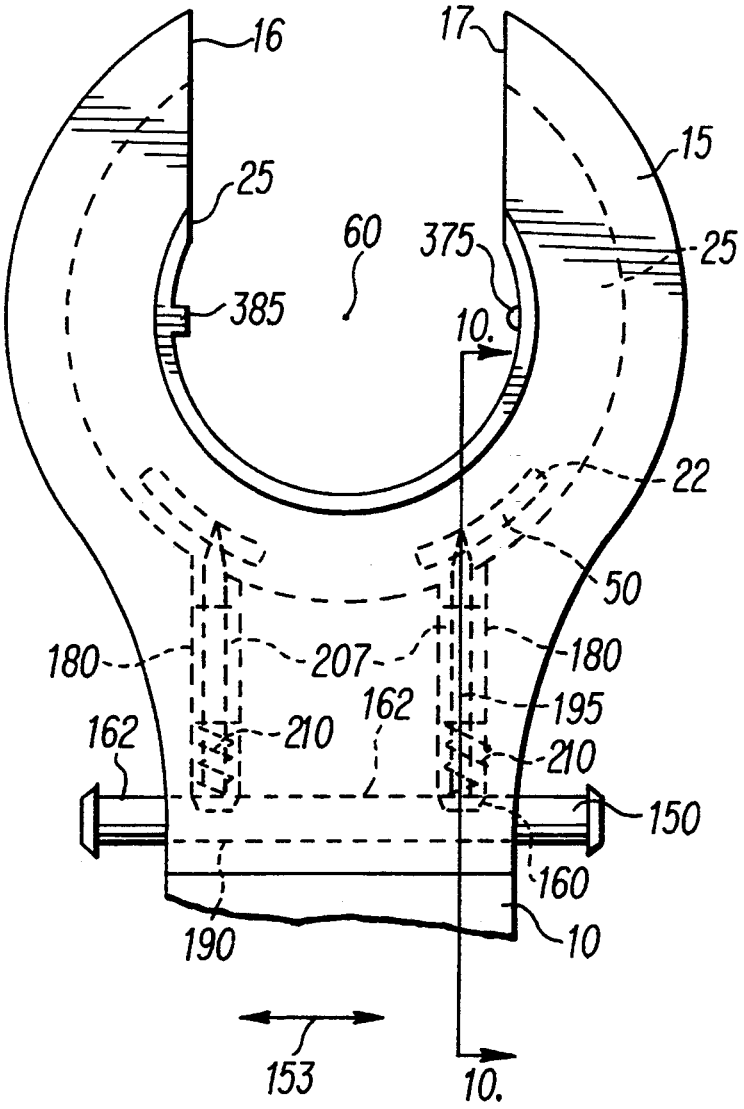
FIG. 9 is a fragmentary top view of the wrench depicted in FIG. 8 on an enlarged scale with some of the internal parts shown in phantom.

The wrench includes a bore 190 that extends through the handle 10 in a direction generally perpendicular to the axis 60, as depicted in FIGS. 8 and 9. An actuating shaft 150 having two cam surfaces 160 thereon is disposed within the bore 190. The actuating shaft 150 is capable of movement in the direction of the arrow 153 in FIG. 9. The wrench is also provided with two parallel bores 180 which extend from the bore 190 to recess 20. The bores 180 are generally perpendicular to both the axis 60 and the bore 190. Within each bore 180 is a cam pin 195. The two pins 195 are identical. One end of each pin 195 has a round head 200 which is configured to contact the cam surface 160 on the shaft 150. The opposite end of each pin 195 includes a tapered portion 205. The pins are biased against the shaft 150 by springs 210. The springs and pins are slidably retained in place by cylindrical bushings 207 which may be either threaded into position or pressed into position with a friction fit.

Figure 10A:
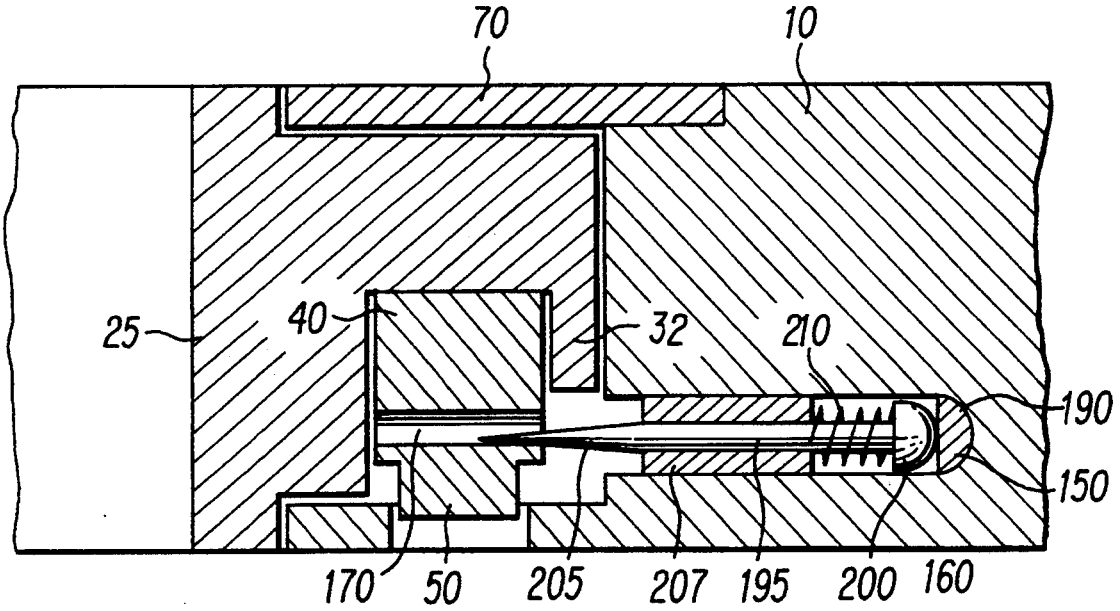
FIG. 10A is a fragmentary section of the wrench taken along the line 10—10 in FIG. 9, on an enlarged scale, looking in the direction of the arrows, showing the pawl engaged with the ratchet wheel.

When the shaft 150 is in a first position, as depicted in FIG. 10A, the pawl 40 is in engagement with the teeth 30 on the wheel 25 and the apertures 170 are slightly offset from the apertures 180. Further, the heads 200 of the pins 195 are engaged with the cam surfaces 160 due to the action of the springs 210.

Figure 10B:
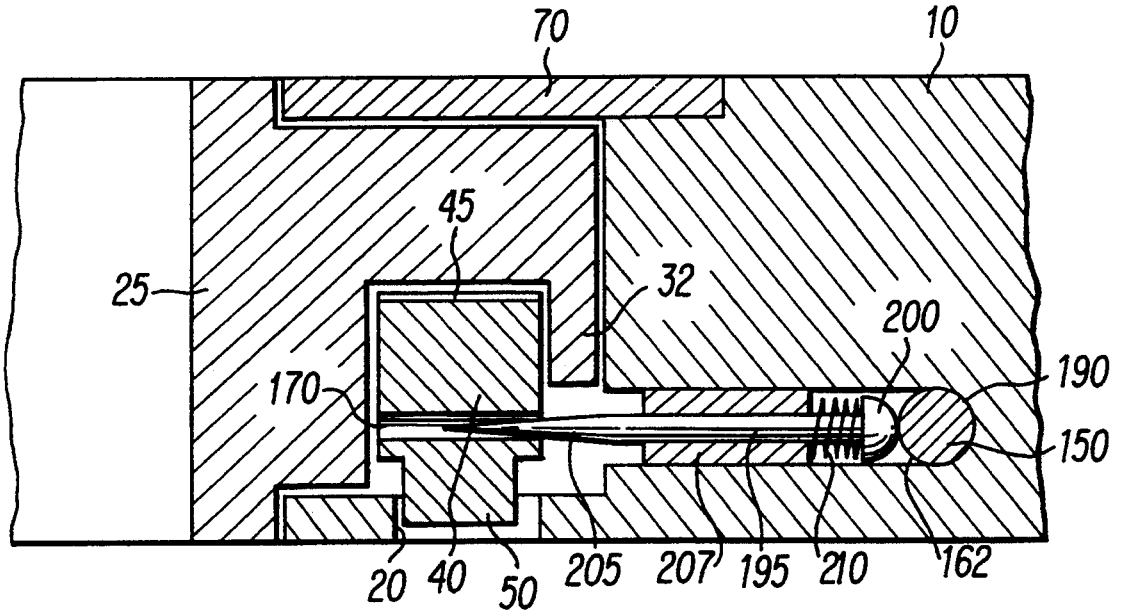
FIG. 10B is a fragmentary section of the wrench taken along the line 10—10 in FIG. 9, on an enlarged scale, looking in the direction of the arrows, showing the pawl disengaged from the ratchet wheel.

When the shaft 150 is in a second position, as depicted in FIG. 10B, the round heads 200 of the pins 195 no longer engage the cam surfaces 160 but instead contact the shank 162 of the shaft 150. The tapered portions 205 extend into the apertures 170 in the pawl 40. Movement of the tapered portions 205 into the apertures 170 causes the pawl 40 to move toward the lower surface 23 of the recess 20, the tapered portion 205 serving as cams. The pawl 40 thus becomes disengaged from the ratchet wheel 25, allowing the ratchet wheel 25 to rotate freely in either direction.

The movement of the pawl 40 is possible because of the configuration of the apertures 170 and the bores 180. When the pawl 40 is in engagement with the teeth 30 on the wheel 35 (FIG. 10A), the apertures 170 are slightly offset from the bores 180 and the pins 195. Movement of the pins 195 into the apertures 170 urges the apertures 170 into alignment with the pins 195. The pawl 40 moves against the force of the springs 65 due to the movement of the pins 195 into the apertures 170 until the tapered portions 205 of the pins 195 are generally centered in the apertures 170.

Figure 11:
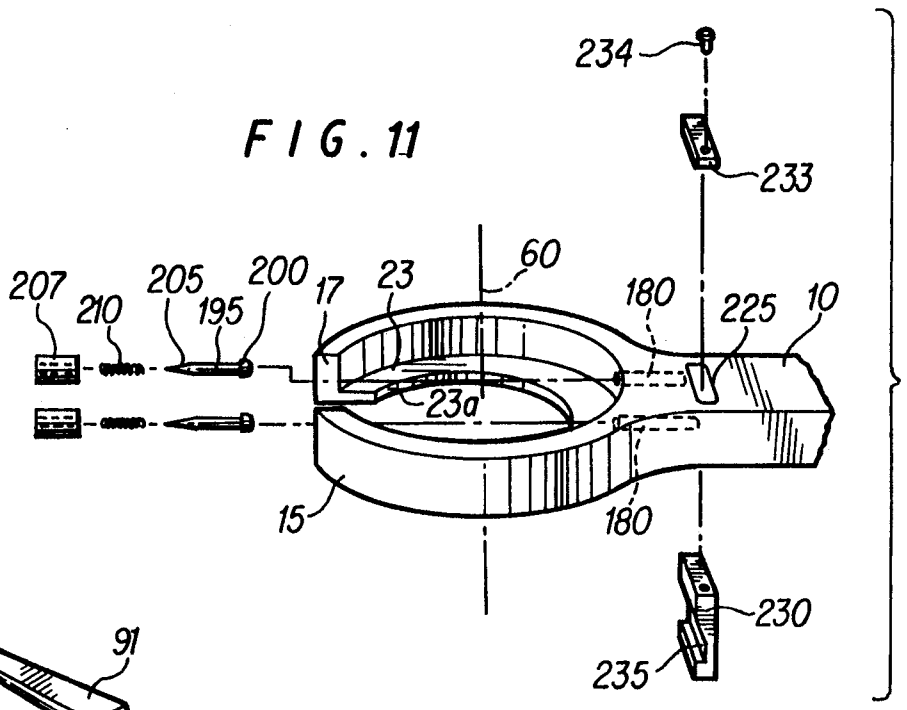
FIG. 11 is a fragmentary, perspective exploded view of the head end of a fourth embodiment of the wrench, similar to the embodiment depicted in FIG. 8, with an actuator shaft that is oriented at a 90° angle to actuator shaft depicted in FIG. 8.

A fourth embodiment of the wrench is partially depicted in FIG. 11. The fourth embodiment generally includes all of the elements described with respect to the third embodiment, such as the pins 195, the springs 210 and the bushings 207. Although not depicted in FIG. 11, the fourth embodiment also includes the pawl 40 having apertures 170, the ratchet wheel 25, the cover 70 and the springs 65. However, the fourth embodiment employs an actuator shaft 230 which is disposed in a bore 225 that is generally parallel to the axis 60. The shaft 230 has generally rectangular shape with a cam surface 235 on one side that contacts the heads 200 on the pins 195. Attached to the upper end of the shaft 230 is a flat retainer 233, held on by screws 234 (only one screw is shown in FIG. 11). Like the previous embodiment, movement of the shaft 230 in a direction parallel to the axis 60 causes the heads 200 of the pins 195 to move and consequently engage or disengage the tapered portion 205 with the apertures 170 in the pawl 40 as was previously described with respect to the third embodiment of the wrench.

A fifth embodiment of the wrench is depicted in FIGS. 12, 13, 14A, 14B, 15, 16A, 16B and 16C. In this embodiment the ratchet wheel 325 is similar to previous embodiments except that ratchet teeth 346 and 347 are provided on each side of the wheel 325 so that rotation of the wheel 325 can be selectively restricted in either direction about the axis 60 as will be explained hereinbelow.

Two pawls 40 and 340 are disposed, one on each side of the wheel 325 such that the teeth on the pawl 40 are selectively engagable with the teeth 346 (FIG. 15) and the teeth on the pawl 340 are selectively engagable with the teeth 347. The handle 10 is provided with two apertures 180, two apertures 180', two pins 195 and two pins 195'. The pawls 40 and 340 are provided with apertures 170 and aperture 170' respectively. The cover 348 includes slots 22'. The pawl 340 is formed with keys 50' which slidably fit within the slots 22' and restrain the pawl 340 from rotation. The pawl 340 is further provided with holes 247 which accommodate the springs 248 which bias the pawl 340 against the teeth 347 on the ratchet wheel 325.

In the fifth embodiment, the handle is provided with two parallel bores 350 and 351. Within the bore 350 is a cam shaft 355, and within the bore 351 is the cam shaft 356. The two shafts 355 and 356 are rigidly attached at the ends to the bars 360 by welds or the screws 363. The shafts 355 and 356 are configured to reciprocate in unison within the bores 350 and 351 in the direction generally depicted by the arrow 361 in FIG. 14A.

Figure 14B:
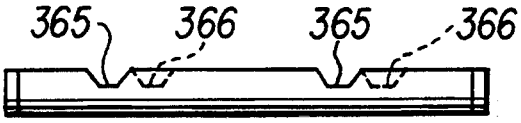
FIG. 14B is a side elevation of the actuating shafts shown in FIG. 13B oriented at a 90° angle to the view in FIG. 14A.
Figure 14A:
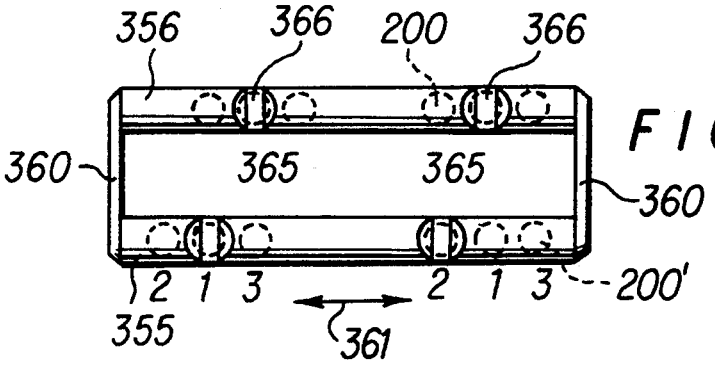
FIG. 14A is a side elevation of actuating shafts shown removed from the wrench depicted in FIGS. 12 and 13.

The shafts 355 and 356 are provided with cam surfaces 365 and 366 as is shown in FIGS. 14A and 14B. The cam surfaces 365 are positioned on the pin 355 and the cam surfaces 366 are positioned on the pin 356. The cam surfaces are arranged to engage the pins 195 and 195' in a manner similar to embodiments described with respect the third and fourth embodiments, although in the fifth embodiment the rotation of the ratchet wheel 325 can be restricted in either direction of rotation.

Figure 16A:
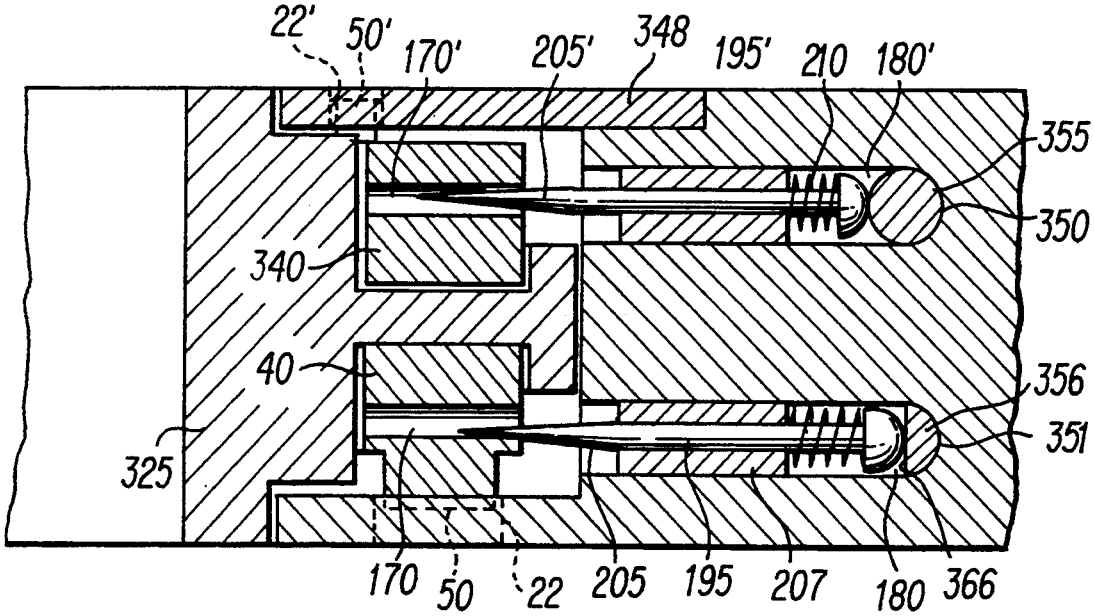
FIGS. 16A, 16B and 16C are fragmentary sections of the wrench taken along the line 16—16 in FIG. 13 on an enlarged scale for clarity, each figure showing different positions of engagement and disengagement of the two pawls with respect to the ratchet wheel.

FIG. 14A depicts, in phantom, the heads 200 and 200' of the pins 195 and 195' and their interaction with the cam surfaces 365 and 366. When the shafts 355 and 356 are in a first position, where the heads 200 of the pins 195 and 195' are at position "1" (FIG. 14A) on the shafts 355 and 356, then the heads 200' engage the shank of the shaft 355 not the cam surfaces 365, while heads 200 remain in contact with the cam surface 366 on the shaft 356 as depicted in FIG. 16A. In this position, the tapered portions 205' of the pins 195' extend into the apertures 170' in the pawl 340, thus pulling the pawl 340 away from the wheel 325 and allowing the wheel 325 to rotate in the direction that would otherwise be restricted by the pawl 340.

Figure 16B:
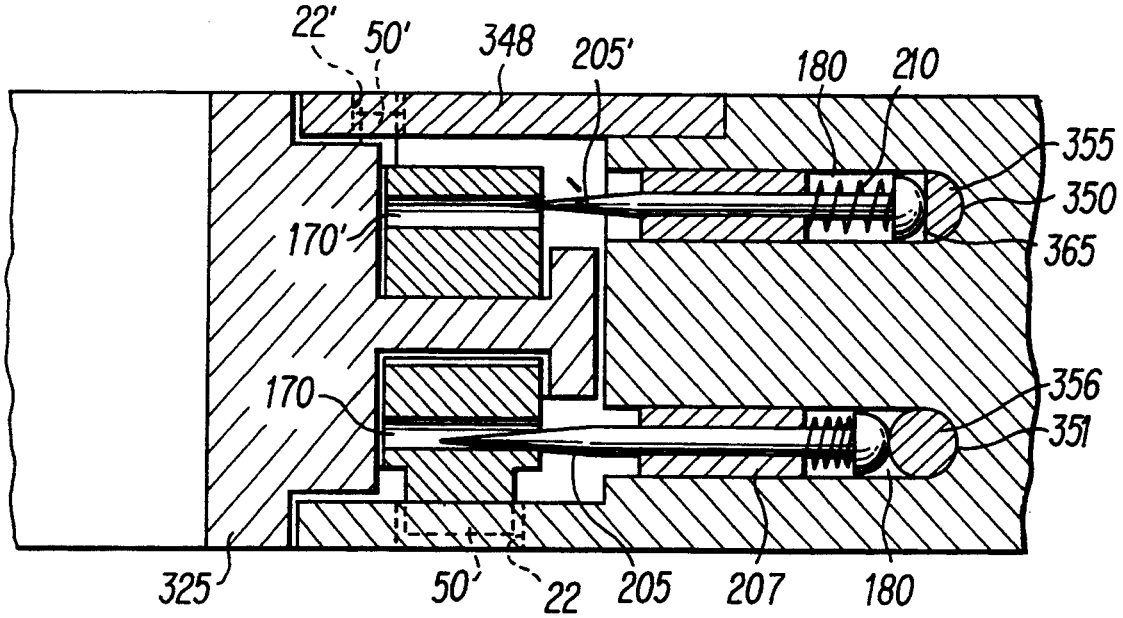

When the actuator shafts 355 and 356 are in the second position, where the heads 200 and 200' are in position "2" (FIG. 14A), then the heads 200 engage the shank of the shaft 356 not the cam surfaces 366, while heads 200' contact the cam surface 365 on the shaft 355 as depicted in FIG. 16B. In this position, the tapered portions 205 of the pins 195 extend into the apertures 170 in the pawl 40, thus pulling the pawl 40 away from the wheel 325 and allowing the wheel 325 to rotate in the direction otherwise restricted by the pawl 40.

Figure 16C:
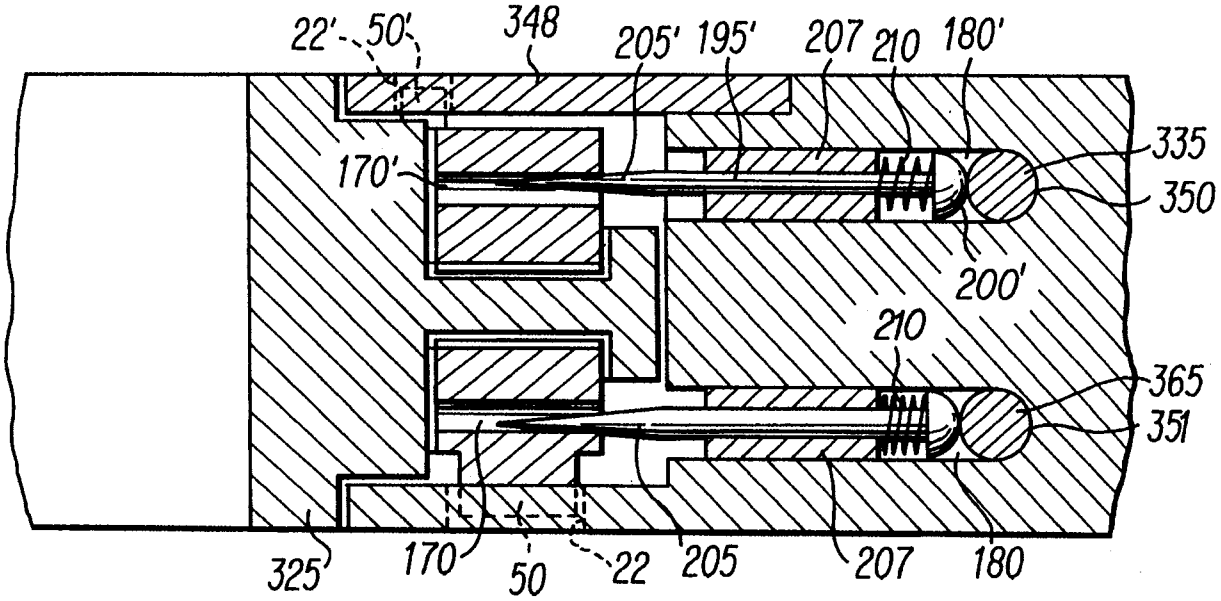

When the shafts 355 and 356 are in the third position, where the heads 200 and 200' are in position "3" (FIG. 14B) then the pins 195 and 195' are all out of contact with the cam surface 365 and 356 and instead contact the shanks of pins 355 and 356. The tapered portions 205 and 205' extend into the apertures 170 and 170', and thus the pawls 40 and 340 are both disengaged from the wheel 325 as is depicted in FIG. 16C. The wheel 325 is free to rotate in either direction.

Figure 15:
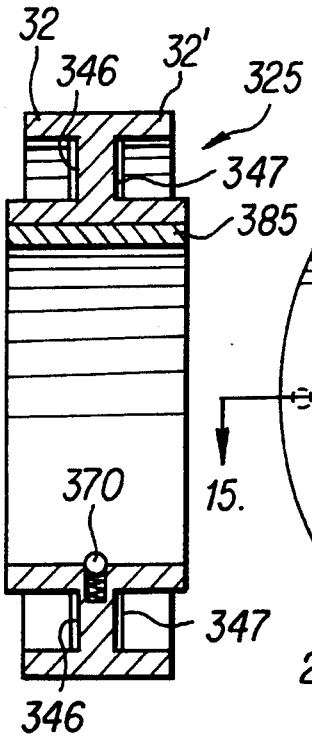
FIG. 15 is a section of the ratchet wheel taken along the line 15—15 in FIG. 13 looking in the direction of the arrows, with the head of the wrench and the pawls removed.
Figure 13:
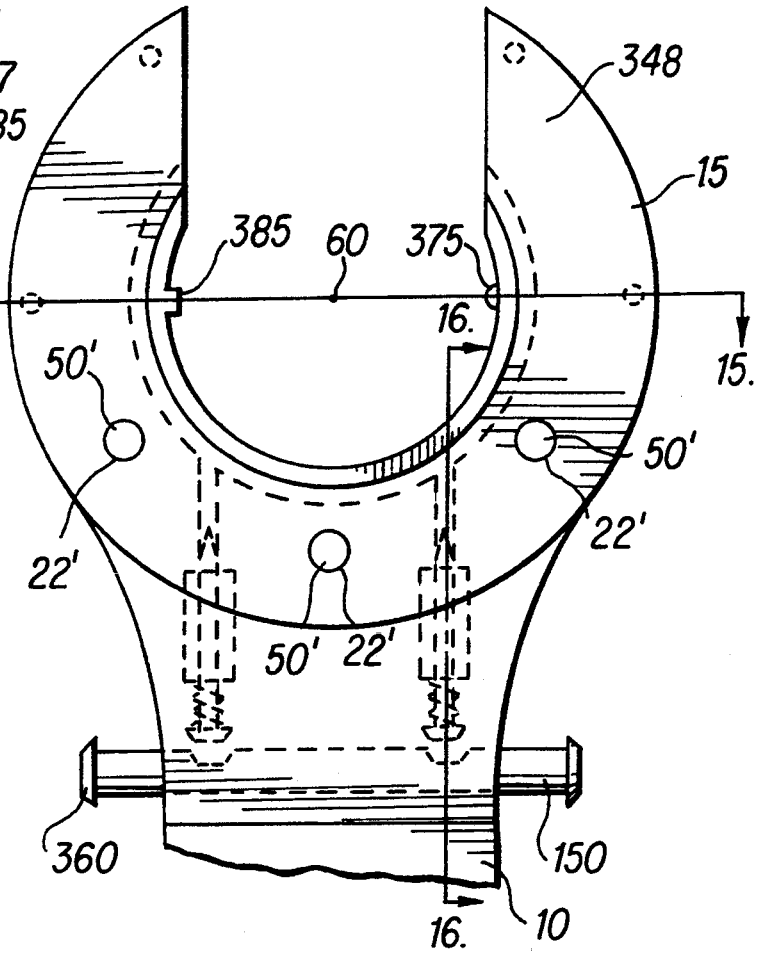
FIG. 13 is a fragmentary top view of the wrench depicted in FIG. 12 on an enlarged scale with some of the internal parts shown in phantom.

As is shown in cross-section in FIG. 15, the gear teeth 346 and 347 are covered and partially protected in a radial direction by the lips 32 and 32'.

As mentioned above, the inner circumference of the ratchet wheel 25 and the wheel 325 is provided with a spring loaded ball detente 375 and the key 385. A variety of wrench inserts or sockets are depicted in FIGS. 17–26, each socket having a square recess 386 and a round recess 376 which coact with the key 385 and the ball detente 375, respectively, so that any one of the variety of sockets may be selected and inserted into the ratchet wheel 25 (or the wheel 325) and used with the ratchet wrench 5.

Referring specifically now to FIGS. 23 and 24, a converting attachment 400 is depicted which includes a standard square drive shank 425 and may be any of the standard sizes such as a three-eighths inch drive or a one-half inch drive thus enabling the wrench 5 to be used with the standard socket sets widely used by both backyard mechanics and professional mechanics.

Figure 27:
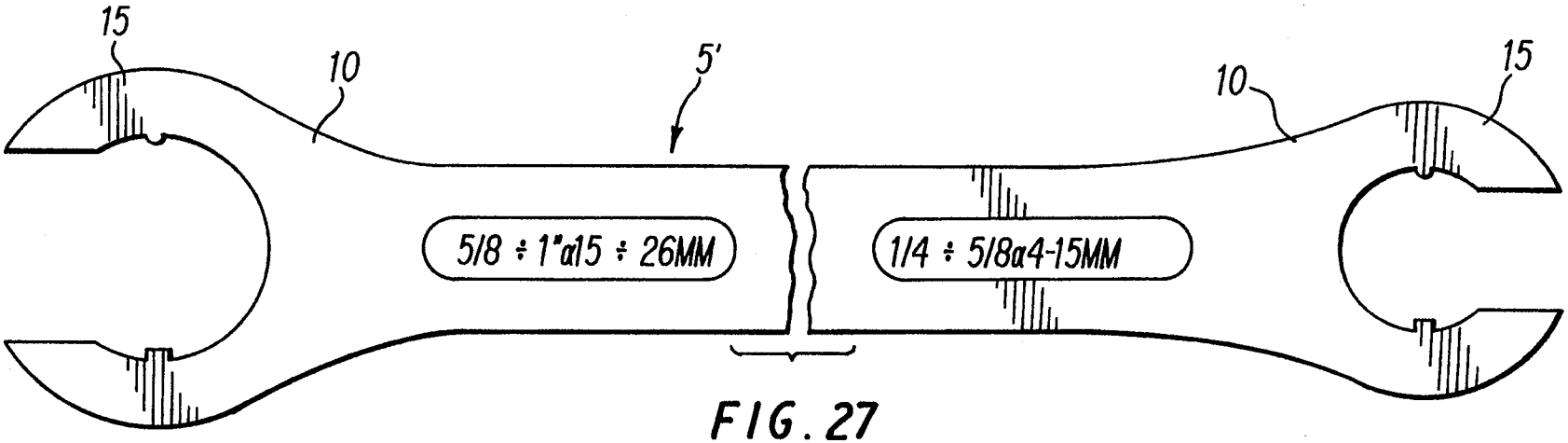
FIG. 27 is a fragmentary top plan view of a sixth embodiment of the invention wherein a ratchet wrench is provided with a ratchet mechanism at both ends of the wrench handle.

FIG. 27 depicts a double ended wrench 5' having two open ends 15. In this embodiment, the ends 15 may be of differing sizes to accommodate differing sized inserts or sockets, thus increasing the number of wrench sizes that may be accommodated by a single handle tool. For instance, one end may be configured to handle sockets for bolt sizes five-eighths inch up to one inch (15 mm up to 26 mm) and the other end may accommodate sizes one-quarter of an inch up to five-eighths of an inch (4 mm up to 15 mm). The ratchet mechanism used in the wrench depicted in FIG. 27 could be any one or combinations of the mechanisms described above with respect to the first, second, third fourth or fifth embodiments of the wrench.

It should also be appreciated, that in each of the embodiments described herein the ratchet wheel may be provided with a fixed bolt-head engaging surface having configurations similar to the surfaces on the insertable sockets depicted in FIGS. 17–26.

Although the present invention has been described with reference to the preferred embodiments, the invention is not limited to the details thereof. Various substitutions and modifications will occur to those of ordinary skill in the art and all such substitutions and modifications are intended to fall within the scope of the invention as defined in the appended claims.

What is claimed:

1. An open-ended ratchet wrench comprising:

a wrench handle having a head formed with an open end, the open end defining an axis that extends therethrough, said head having a recess formed on an inner surface thereof;

a ratchet wheel seated in said recess for rotation about said axis, said wheel having a radially extending surface that is generally perpendicular to said axis, said surface being provided with a plurality of ratchet teeth;

a pawl disposed within said recess and restrained against rotation about said axis, said pawl being provided with a plurality of pawl teeth disposed for movement into and out of engagement with said ratchet teeth; and a release mechanism for selectively moving said pawl in a direction generally parallel to said axis, said mechanism being at least partially disposed within said wrench handle.

2. An open-ended ratchet wrench as in claim 1 wherein said release mechanism comprises a cam which is engagable with said pawl for selectively moving said pawl.

3. An open-ended ratchet wrench as in claim 2 further comprising a plate attached to said pawl for engagement by said cam for moving said pawl.

4. An open-ended ratchet wrench as in claim 1 wherein said ratchet wheel further comprises an outer circumferential lip which protrudes in an axial direction away from said ratchet teeth and partially covering said teeth.

5. An open-ended ratchet wrench as in claim 1, further comprising said handle having a first bore formed therein extending through said handle and at least one pin aperture extending from said first bore to said recess in said head, said pawl having at least one aperture generally parallel to said pin aperture, wherein said release mechanism comprises at least one slidable cam pin disposed in said pin aperture and an actuating shaft disposed in said first bore, said actuating shaft having at least one cam surface thereon for selectively moving said cam pin into engagement and disengagement with said aperture in said pawl for engaging and disengaging said pawl with said wheel.

6. An open-ended ratchet wrench as in claim 5 wherein said actuator shaft is reciprocatable in a direction parallel to said axis.

7. An open-ended ratchet wrench as in claim 5 wherein said actuator shaft is reciprocatable in a direction perpendicular to said axis.

8. An open-ended ratchet wrench as in claim 5 further comprising:

a second set of ratchet teeth on a second surface of said ratchet wheel generally perpendicular to said axis;

a second pawl disposed within said recess having at least one aperture therein and having pawl teeth configured to engage said ratchet teeth on said second surface of said ratchet wheel;

said handle having a second bore generally parallel to said first bore and at least one second pin aperture extending from said second bore to said recess in said head;

a second actuator shaft disposed within said second bore having at least one cam surface;

at least one cam pin disposed within said second pin aperture, said cam pin having a head for engaging said second cam surface on said second actuator shaft and having a tapered surface engagable with said second pawl aperture.

9. An open-ended ratchet wrench as set forth in claim 1 further comprising a plurality of interchangeable socket members operably retainable within said ratchet wheel and wherein said ratchet wheel has means for retaining said socket members.

10. An open-ended ratchet wrench comprising:

a handle having an open end, the open end having a recess formed on an inner surface thereof, said open end defining an axis that extends therethrough;

a ratchet wheel seated within said recess for rotation about said axis, said wheel having a circumferential wheel recess formed therein, said wheel recess defining an outer radial lip and a radially extending surface perpendicular to said axis, said radially extending surface having a plurality of ratchet teeth formed thereon;

a pawl partially disposed within said wheel recess configured to move in a direction parallel to said axis for engaging and disengaging said ratchet teeth, said pawl spring biased to engage said ratchet teeth;

a release mechanism disposed in said handle for selectively engaging and disengaging said pawl from the ratchet teeth.

11. An open-ended ratchet wrench as set forth in claim 10 further comprising said release mechanism comprises a lever having a cam attached thereto;

a plate attached to said pawl such that said cam is selectively engagable with said plate to move said pawl and said plate.

12. An open-ended ratchet wrench as set forth in claim 10, further comprising:

said handle having a bore formed therein and an aperture extending from said bore to said recess;

wherein said release mechanism comprises a reciprocatable actuator shaft disposed in said bore, having at least one cam surface thereon;

at least one cam pin disposed in said handle aperture, said pin having a head at one end and a tapered cam surface at its other end, said head on said pin engagable with said cam surface;

said pawl having at least one aperture for operably receiving said pin cam surface.

13. An open-ended ratchet wrench as set forth in claim 12 further comprising:

said ratchet wheel having a second circumferential recess formed on a second axial face thereof, a second set of ratchet teeth formed within said second wheel recess generally perpendicular to said axis;

a second pawl partially disposed within said wheel recess having at least one aperture therein;

said handle having a second bore formed therein and at least a second aperture extending from said second bore to said recess;

at least one second cam pin disposed within said second aperture, said second pin having a head engagable with said cam surface on said actuator pin and having a tapered cam surface engagable with said pawl aperture.

14. An open-ended ratchet wrench comprising:

a handle having an open end, the open end having a recess formed on an inner surface thereof, the open end defining an axis that extends therethrough;

a ratchet wheel seated within said recess for rotation about said axis, said wheel having a circumferential recess formed on an axial face, said recess having a plurality of ratchet teeth formed therein and said recess defining an axially extending lip that partially covers said ratchet teeth;

a pawl restrained against rotation within said handle recess and extending partially into said ratchet wheel recess, said pawl having a plurality of pawl teeth configured to engage said ratchet teeth;

a release mechanism disposed in said handle for selectively engaging and disengaging said pawl from said ratchet teeth.

* * * * *